US005398430A

United States Patent [19]

Scott et al.

[11] Patent Number: 5,398,430

[45] Date of Patent: Mar. 21, 1995

[54] EARTH MOVING AND COMPACTING RIG

[76] Inventors: Thomas M. Scott; David R. Scott, both of Rte. 1, Box 914, Petersburg, W. Va. 26847

[21] Appl. No.: 838,167

[22] Filed: Feb. 20, 1992

Related U.S. Application Data

[63] Continuation of Ser. No. 702,405, May 20, 1991, abandoned.

[51] Int. Cl.[6] ..... E02F 3/76; E02F 3/24

[52] U.S. Cl. ..... 37/142.5; 37/403; 37/379; 37/184

[58] Field of Search ..... 37/80 R, 103, 118 R, 37/141 R, 183 R, 184, 185, 186, 187, 188, DIG. 18, DIG. 12; 209/421; 414/722

[56] References Cited

U.S. PATENT DOCUMENTS

| | | | |
|---|---|---|---|
| 2,142,794 | 1/1939 | Matthews | 37/183 R |
| 3,003,265 | 10/1961 | Lutjens | 37/118 R X |
| 3,072,257 | 1/1963 | Hockenberry | 37/138 R X |
| 3,732,980 | 5/1973 | Evers et al. | 37/117.5 X |
| 4,157,956 | 6/1979 | Robinson | 209/421 X |
| 4,189,386 | 2/1980 | Aman | 37/183 R X |
| 4,592,696 | 6/1986 | Carternock | 37/DIG. 18 X |
| 4,679,337 | 7/1987 | Carternock et al. | 37/DIG. 18 X |
| 4,698,150 | 10/1987 | Wigoda | 209/421 |
| 4,698,926 | 10/1987 | Caplis et al. | 37/DIG. 18 X |
| 4,790,717 | 12/1988 | Anderson | 414/722 |

*Primary Examiner*—Randolph A. Reese
*Assistant Examiner*—Spencer Warnick
*Attorney, Agent, or Firm*—Walter G. Finch

[57] ABSTRACT

An earth moving and tamping apparatus rig is provided which can backfill a trench and compact the backfill materials up to 95% compaction. A bucket and a vibrator are attached to a backhoe. The bucket retrieves the filling material and either dumps the material into a trench or sifts it through adjustable screening blades that form the bottom of the bucket. The apparatus includes a means to swivel the bucket 360° with respect to the boom. The end of the bucket then compacts the filling materials into the trench. Each moving rig apparatus may also be equipped with an alternative two-bucket system, where one bucket fits inside the other one or is along side thereof. For trenches as wide as two feet to increase the area of dirt tamped, the two-bucket may be secured in juxtaposition to each other. For more narrow trenches, the second bucket may be closed inside the first bucket and the area tamped will only be the width of a single bucket. The earth moving and tamping apparatus rig is a device by which a backfilling job may be done more efficiently and less expensive than the present method employing multiple workers and machines.

7 Claims, 5 Drawing Sheets

EARTH MOVING AND COMPACTING RIG

This patent application is a continuation of U.S. patent application Ser. No. 07/702,405, filed May 20, 1991, for "Earth Moving and Compacting Rig" by Applicants, now abandoned.

BACKGROUND AND SUMMARY OF THE INVENTION

This invention relates generally to construction and earth moving machinery, and more specifically it pertains to an apparatus for backfilling trenches and compacting the filling material.

The main essence of this device is that it enables one man to operate one machine to perform a task that ordinarily would require several men and machines. Where a backfilling job normally needs a loader or bulldozer to fill the trench, and a hand-operated wacker or backhoe plates to compact it, this earth moving rig of this invention can do the entire job alone.

The rig accomplishes this by using a bucket to load dirt and release it into a ditch. The bucket then swivels so that the flat end of it may be used to tamp down the dirt, while an attached vibrator unit aids in compaction of the dirt. Operated by a single worker, one earth moving rig obtains results that heretofore necessitated multiple machines and workers.

The uniqueness of the rig is that it includes a means by which to retrieve dirt and place it in a recess as well as a means by which to vibrate the bucket and compact the dirt filling material. While dirt retrieval and compaction are ordinarily functions of separate pieces of equipment, this invention is a combination of both.

Versatility of function is possible by a means for swiveling the bucket with respect to the boom. An operator can swivel the bucket or tamping plate 360° with respect to the boom of implement as to allow tamping plate to fit parallel to the trench at any given angle of implement to trench. In this manner, the end of the bucket may be used with the vibrator to tamp down the filling material.

This invention also includes a means by which the dirt may be screened for unwanted large rocks or debris by filling bucket and vibrating the bucket to shake and separate rock and debris. The back side of the bucket is made up of adjustable blades that may be clamped in a variety of fixed positions, i.e., up, down or partially down. A removable handle manipulates the clamp.

When the blades are clamped up, the opening between them allows the dirt to sift through while the larger rocks and debris are caught. Blades clamped down close the openings and permit no material to filter through. Thus, the earth moving rig can screen the filling material or not, as the operator chooses.

The rig may also be equipped with an adjustable clamshell bucket system, where one bucket fits inside the other. The advantages of this is the ability to handle backfill material of two bucket quantity, and yet still close one inside the other to provide a narrow dimension tamping plate for narrow ditches. The buckets can be partially opened to provide a wider tamping plate for wider ditches. A second bucket will allow more of the ditch to be tamped.

The clamshell bucket system functions in the following manner. The buckets retrieve dirt by an opening and grasping motion, similar in fashion to a clam's movement. Hydraulic cylinders activate the opening and closing of the buckets. To dump the filling material in the trench, the operator may open the buckets, which allows the material to fall through the separation. The buckets then may be closed until the total surface area of both bucket ends equals the width of the trench.

The buckets can be adjusted to the desired width. The operator may then use the bucket ends and the vibrator to compact the dirt. Consequently, the operator does not need to move the bucket from one side of a two-foot trench to the other, as a single bucket-system would require. In this manner, the clamshell bucket system speeds up the compaction process.

SUMMARY OF THE INVENTION

In summary, the earth moving rig is a single machine that entails one or two buckets, a vibrator, and a means for swiveling the bucket. This invention is capable of backfilling trenches that would normally necessitate a dozer or loader, and compacting the backfill materials in the trench up to 95% compaction. Thus, the invention eliminates the need of clumsy, hand-operated wackers, vibrating backhoe plates, as well as other extra pieces of machinery. While generally useable for most backfill jobs, this apparatus is specifically instrumental during installation of water and sewer lines along narrow roads and street where room is restricted on either side of trench. Used correctly, the earth moving rig will increase efficiency and cut costs of a backfill job.

OBJECTS OF THE INVENTION

It is an object of this invention to provide an apparatus operational by a single wacker for use in construction and earth moving situations that will backfill a trench or ditch as well as compact the filling materials.

Still another object of the invention is to provide a swiveling motion 360° of the bucket connection to the vibrator and boom means of the implement either hydraulically or manually.

And to provide a means by which to accomplish the first mentioned object as well as vibrating bucket means with screen located in the back side to separate unwanted large rocks and debris or not, as the operator chooses is a further object of the invention.

To provide a means by which to accomplish the first mentioned object along with an alternative two-bucket system that speeds up the backfilling process is another object of this invention.

Further another object of the invention is an alternative clamshell bucket system that retrieves dirt by a grasping motion.

To provide a clamshell bucket system that opens to dump the filling materials into a trench and closes one bucket inside the other to provide a narrow dimension tamping plate for narrow trenches and also can be partially opened to provide a wider tamping plate that may tamp a ditch up to two feet in width is still further an object of this invention.

Still a further object of this invention is that it eliminates the need for other machinery or equipment to perform a backfill job.

And to provide apparatus that will compact to rates required by the legal authorities and laws is still a further object of this invention.

To provide an apparatus that will increase efficiency and cut costs of an ordinary backfill job, is a further object of this invention.

BRIEF DESCRIPTION OF THE DRAWINGS

These and other objects and attendant advantages of this invention will become more obvious from the following drawings and detailed description of the invention wherein.

DESCRIPTION OF THE PREFERRED EMBODIMENTS

Figure 1:
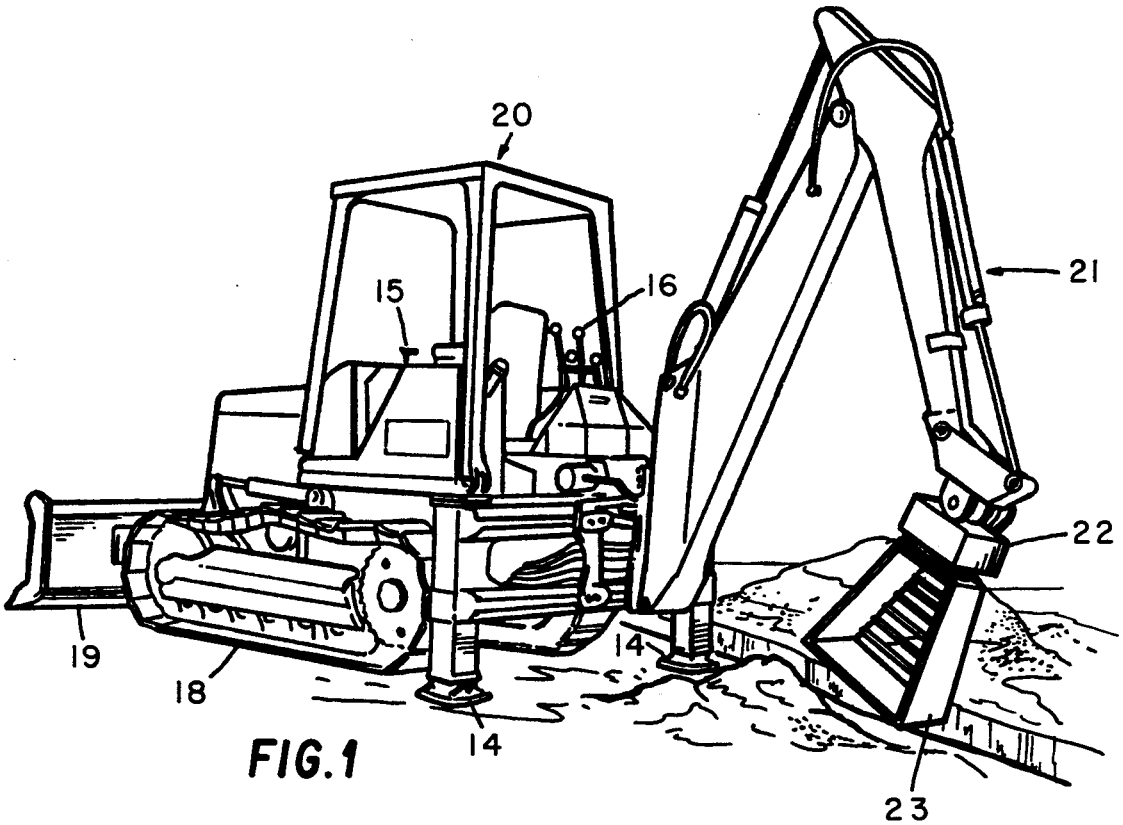
FIG. 1 is a perspective view of an earth moving and tampering rig incorporating features of this invention.

Referring now to FIG. 1 of the drawings, there is shown a backhoe rig 20 complete with a boom 21, on the end of which is attached a vibrator 22 and a bucket 23. In addition, the ~~rig~~ 20 is provided with a blade 19, tracks 18 for moving the rig 20, and controls 15 for up and down movement of the blade 19 and controls 16 for forward and backward motion of the rig 20 for moving and controlling the rig 20. A pair of stabilizers 14 are provided for stabilizing the rig 20.

Figure 2:
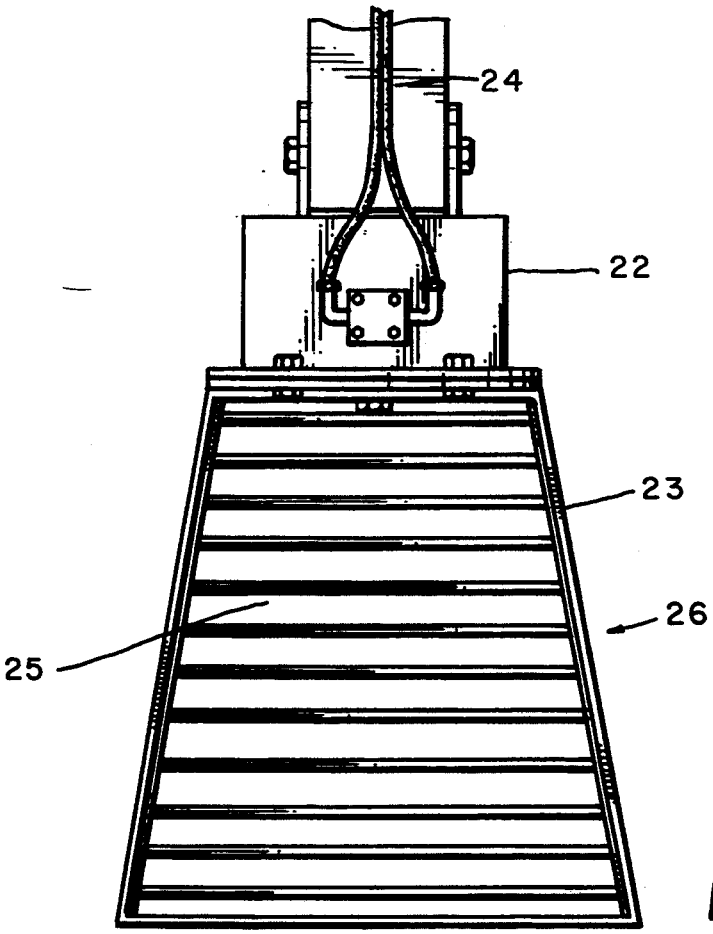
FIG. 2 is a front view of a bucket.

In FIG. 2 there is shown hydraulic lines 24 from the rig 20 to control and activate the vibrator 22, which is attached to one end of the bucket 23. FIG. 2 also shows a plurality of spaced rods 25 for forming a sieve 26 in the bucket 23.

Figure 3:
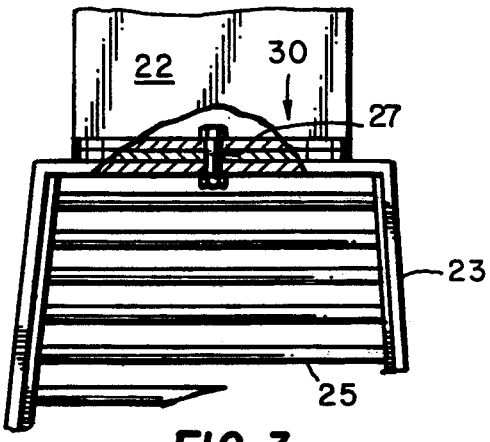
FIG. 3 is a front view of a swivel connection for the bucket.

Referring now to FIG. 3, a swivel 30 consisting of a two headed shaft 27 which joins the vibrator 22 to the bucket 23. Any other suitable arrangement can be used in a swivel, such as a bolt.

Figure 4:
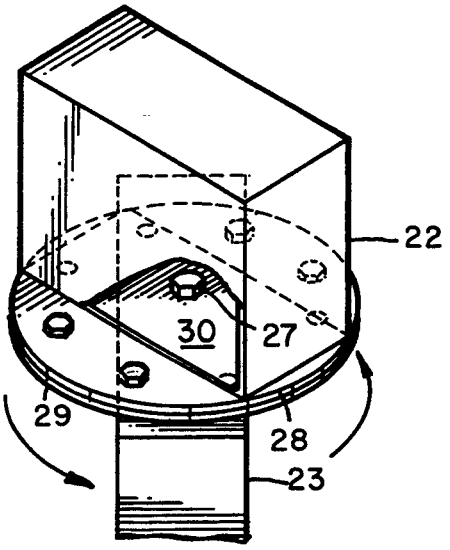
FIG. 4 is a perspective view of a swivel shaft connection for rotating the buckets below the vibrating means.

FIG. 4 shows the swivel mechanism in more detail, where the swivel 30 turns on its shaft 27 and may secure the buckets 23 in place with vibrator 22 in any position needed with locking bolts 33 holding the swivel plates 28 and 29 in fixed position.

Figure 5:
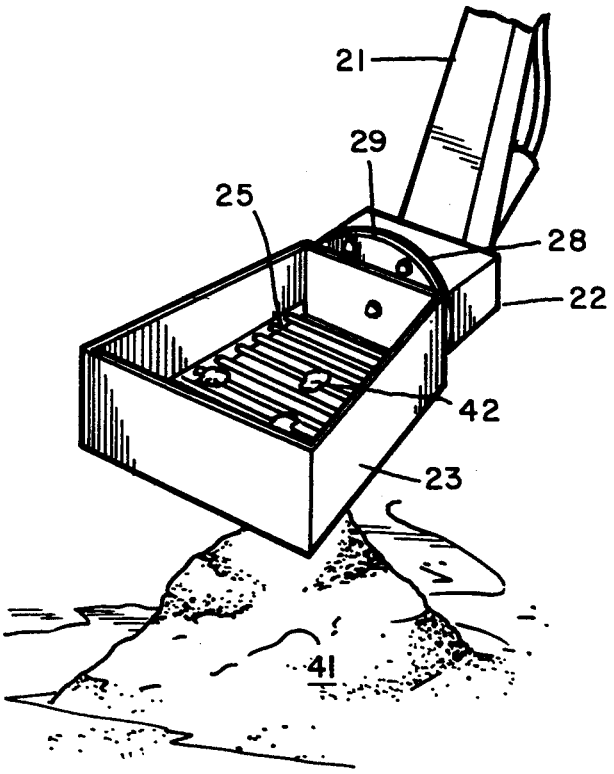
FIG. 5 is a perspective view of the bucket sifting.

Referring now to FIGS. 2, 3 and 5, the screening bars or rods 25 are shown mounted in the back of the bucket 23 to catch or screen rocks or debris 42 while allowing the dirt 41 to fall through. The vibrator 22 may be activated to aid in shaking the dirt 41 through the screening bars 25.

Figure 6:
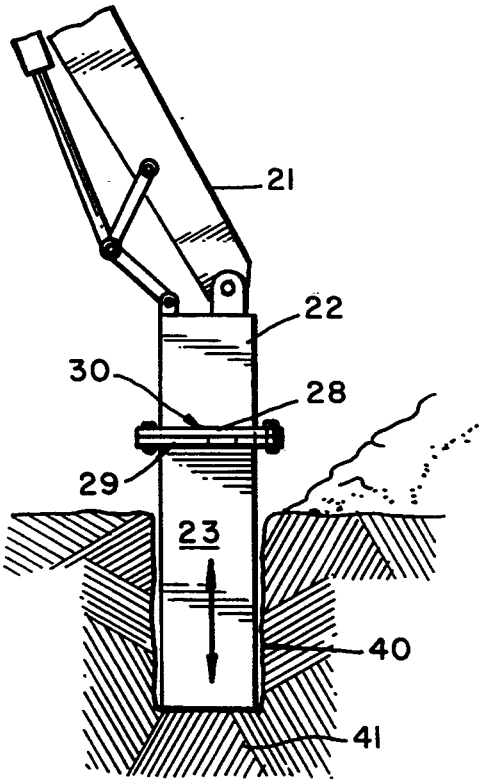
FIG. 6 is a cross section of the bucket pounding down on the earth in a narrow trench.
Figure 7:
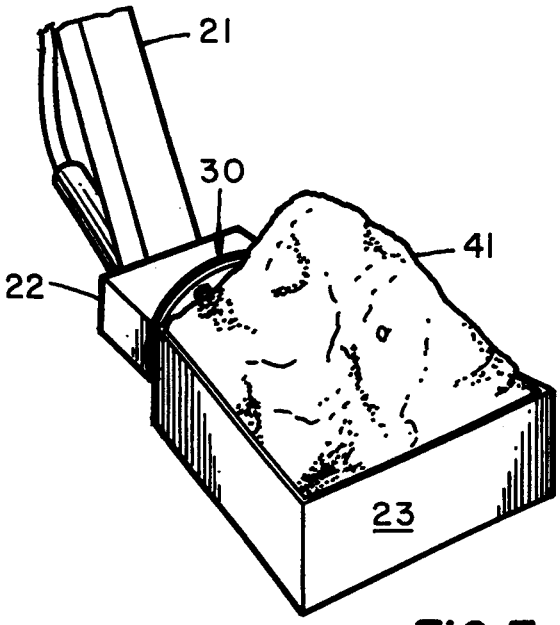
FIG. 7 is a perspective view of the bucket with a full load and base.

Referring now to FIG. 6, the rig 20 is shown tampering or packing the dirt 41 in a trench 40. The vibrator 22 can be activated with the bucket 23 as shown in the position of FIG. 5, to allow the dirt to fall through, with the rocks 42 being retained. In FIG. 7, there is shown a bucket 23 filled with dirt 41. The screening bars 25, best shown in FIG. 5, are closed.

Figure 8:
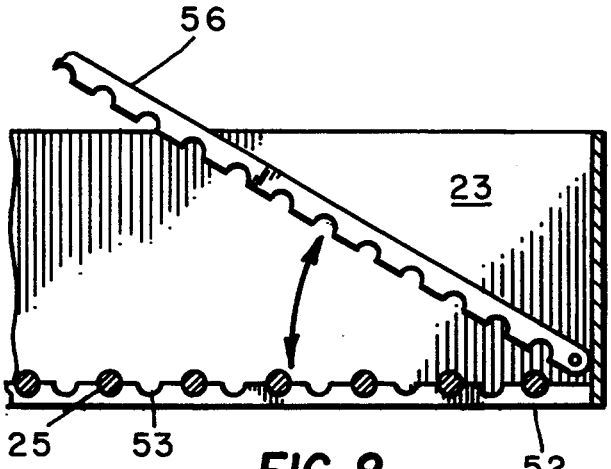
FIG. 8 is a side view of one embodiment of a bucket, partially in cross section, showing the bars used for sifting.

Now referring to FIG. 8, the bucket 23 with the screening bars 25 with an upper clamp 56 and a lower clamp 52 to secure the screening bars 25 in the position desired. There is also shown space recesses 53 for receiving the bars 25.

Figure 9:
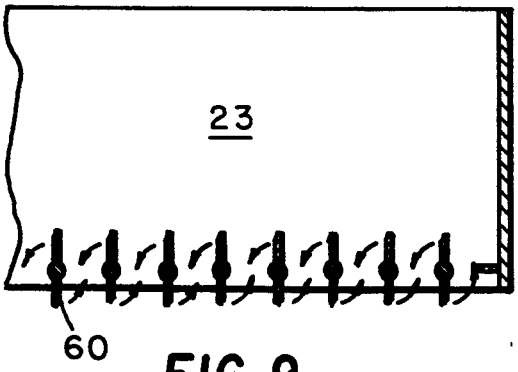
FIG. 9 is a side view of a second embodiment of a bucket, partially in cross section, showing a bucket having a sieve.

FIG. 9 illustrates rotating adjustable blades 60 in the open position in the bucket 23 and may be used as a sieve.

Figure 10:
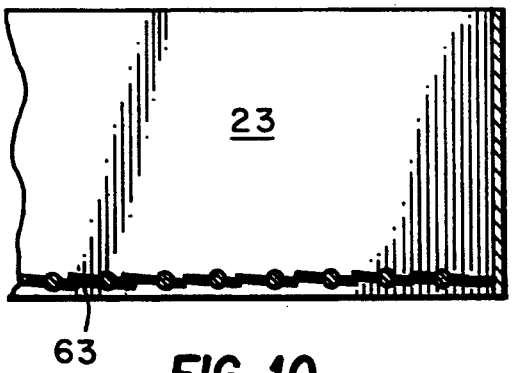
FIG. 10 is a side view, partially in cross section, showing a bucket with a solid base.
Figure 11:
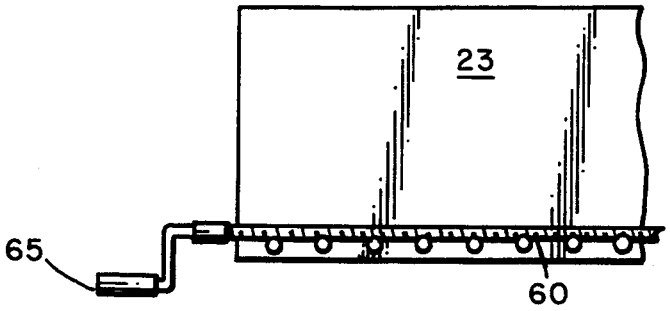
FIG. 11 is a side view, partially in cross section, showing a mechanism for adjusting the base.

Similarly in FIG. 10, the blades 63 are in the closed position in the bucket 23, and a solid base allows no dirt through. A removable handle 65 may be used to adjust the blades 60, manually from the outside of the bucket 23 as shown in FIG. 11 mechanism.

Figure 12:
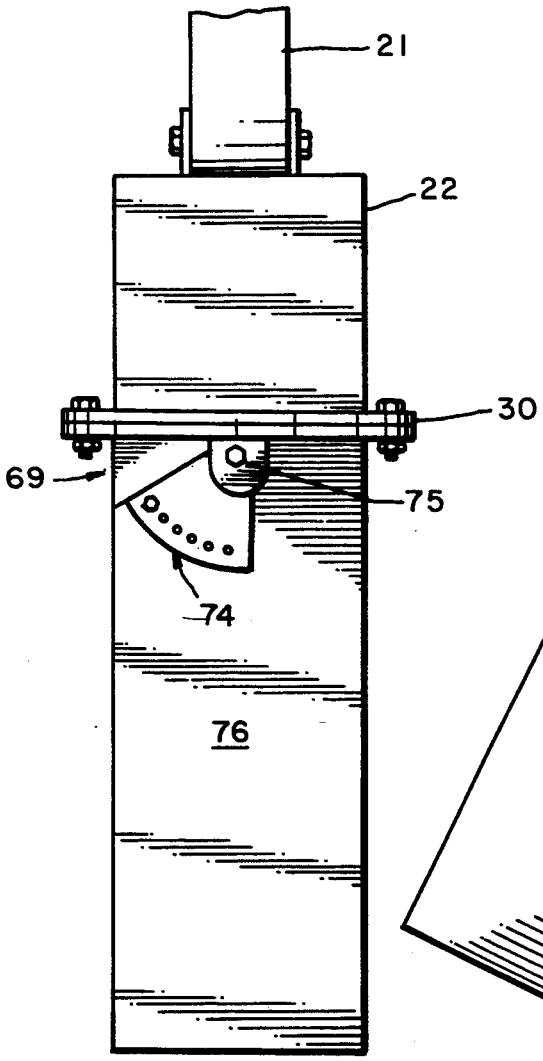
FIG. 12 is a side view of a second embodiment of a bucket showing a clamp mechanism.
Figure 13:
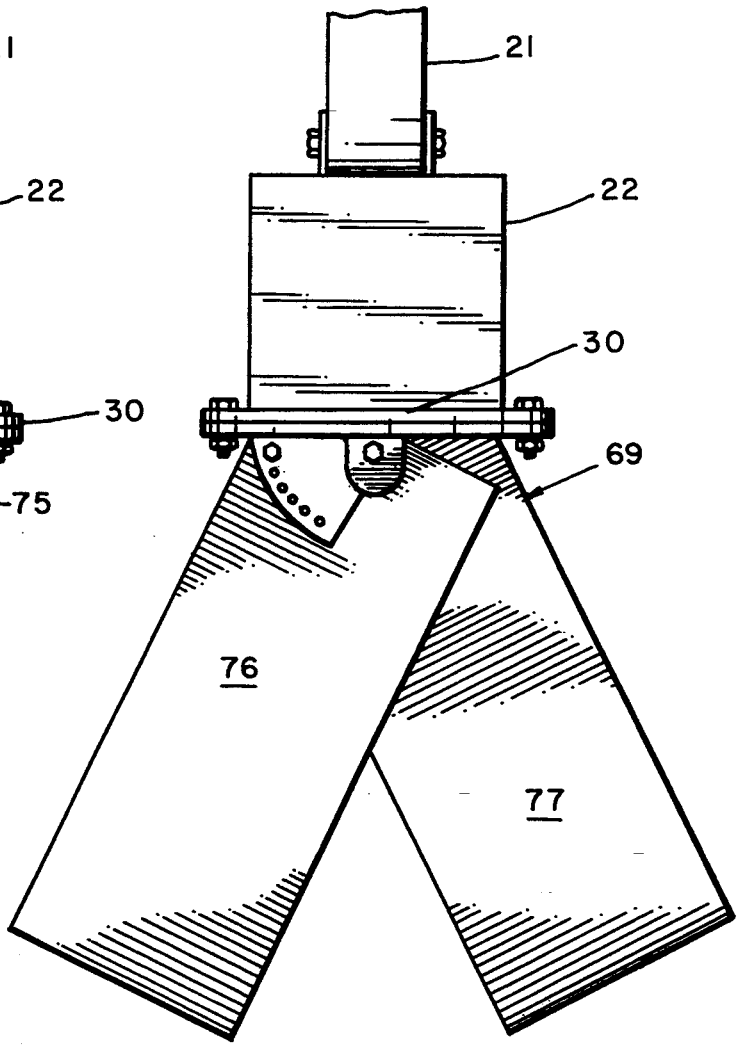
FIG. 13 is a side view of the second embodiment of the bucket in an open position.
Figure 15:
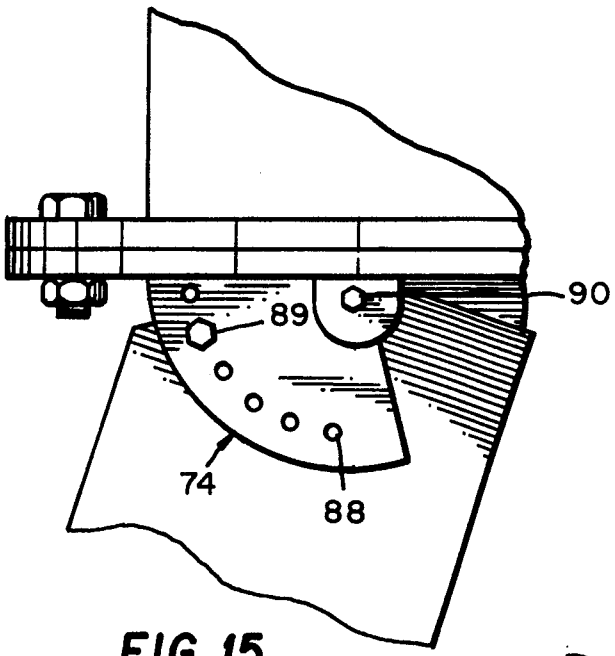
FIG. 15 is a side view showing stop catches for the second embodiment of the bucket.

FIGS. 12 and 13 illustrates a clamshell bucket system 69 where one bucket 77 is inside the other bucket 76. A stop catch mechanism 74 best shown in FIG. 15, is an adjustment mechanism to stop buckets 76 and 77 from closing all the way together to provide a wider tamping plate at the bottom of buckets 76 and 77 in the clamshell bucket system 69. FIG. 13 shows the two buckets 76 and 77 in the open position. The stop catch mechanism 74 is best shown in FIG. 15. A stop catch 89 is caught in an aperture 88, and that stops buckets 76 and 77 from closing all the way together this making an adjustment of the width of the tamping plates or bottom of buckets 76 and 77. A hinge joint 90 best shown in FIG. 15, allows the buckets 76 and 77 to swing open and shut.

Figure 14:
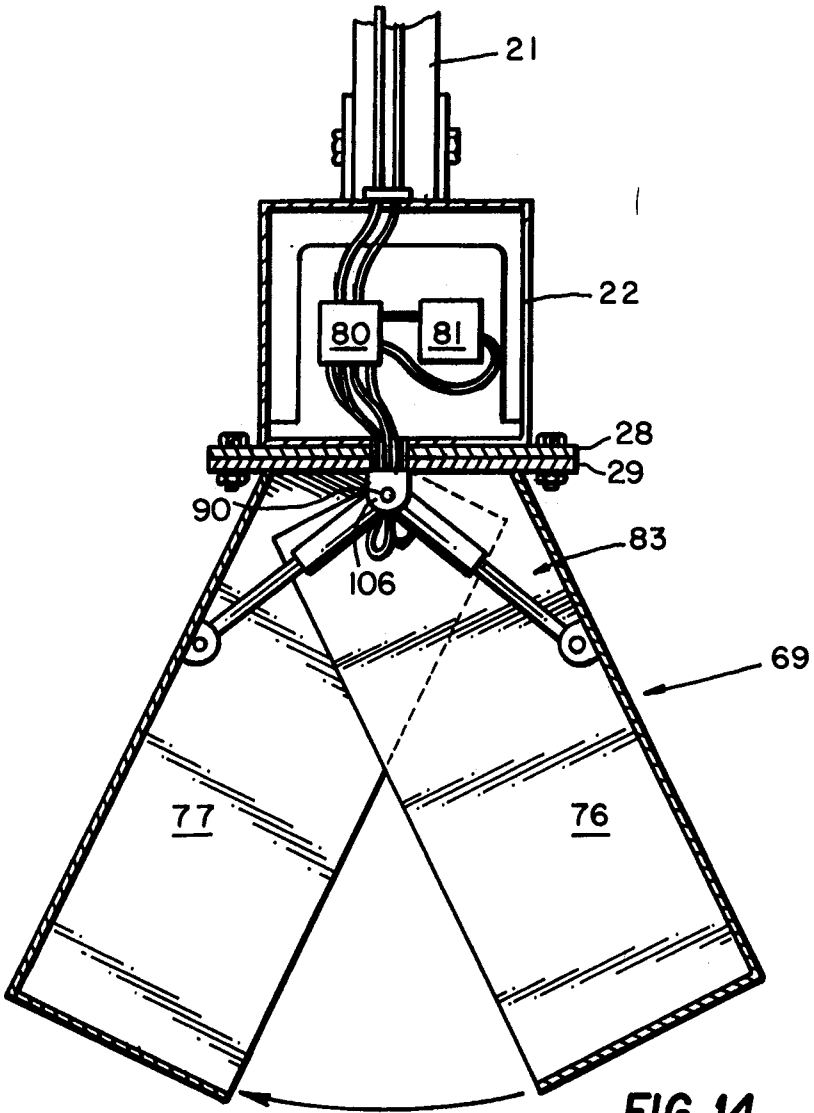
FIG. 14 is a sectional view of the second embodiment of the bucket in an open position as shown in FIG. 13.

The operation of the clamshell bucket system 69 is best shown in FIG. 14. A hydraulic motor 81 activates the vibrator 22 and a hydraulic control valve 80 activates the buckets 76 and 77 and vibrator 22. Hydraulic cylinders 83 cause the buckets 76 and 77 to swing open or close on the hinge joint 90 best shown in FIG. 15.

Figure 16:
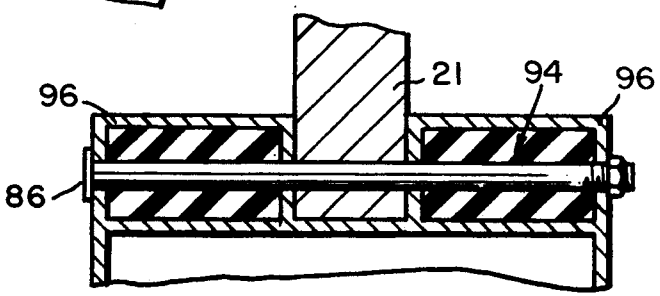
FIG. 16 is a side view partially in cross section of rubber mounts on the back hoe boom to cut down on vibration.

In another version of the invention as best shown in FIG. 16, the boom means or supporting arm 21 on which the vibrator 22 is attached, is connected to the vibrator 22 by a pin attachment shaft 86 located through rubber bushings 94 that are fixed to the top of the vibrator support cage with bushing brackets 96. This connection absorbs vibration from the boom 21 of the vibrator 22 that is bolted to a bottom plate 28 of the vibrator support cage. This, in turn, is bolted to the top plate 29 of buckets 76 and 77 that hinge on shaft 90 with brackets 106. A pin 90 and bracket 106 make up the hinge joint of buckets 76 and 77 that open and close with hydraulic cylinders. Adjustable tamping plates are located at the bottom of the buckets 76 and 77. The pin attachment shaft 86 allows the combination of both vibrator 22 and buckets 76 and 77 to pivot on the end of the boom.

Obviously many modifications and variations of the present invention are possible in the light of the above descriptions. It is therefore to be understood that within the scope of the appended claims the invention may be practiced otherwise than as specifically described.

We claim:

1. A system for tamping of material in a trench opening, comprising, a powered vehicle having a boom means coupled to said vehicle at one end and adjustably controlled therefrom and having an opposite end, bucket means coupled to said opposite end of said boom means, said bucket means consisting of a pair of buckets operating as a clamshell bucket, with one of said pair of buckets closing inside the other of said pair of buckets so as to provide a narrow tamping plate to fit into a narrow trench opening, vibrating means coupled to the end of said boom means and external of said bucket means for periodically vibrating said bucket means so as to assist in tamping and in compacting material dumped in said trench opening by said bucket means, and means positioned between said vibrating means and said boom means for absorbing and minimizing vibrations during the tamping and compacting of material placed by said bucket means in said trench opening.

2. A system for tamping of material in a trench opening as recited in claim 1, wherein said bucket means has a bottom having a rectangular configuration so that said bottom of said bucket means is flat for use as said tamping plate.

3. A system for tamping of material in a trench as recited in claim 1, and means for swivelling said bucket means to allow said tamping plate to fit into said narrow trench opening at any angular position relative to said narrow trench opening.

4. A system for tamping of material in a trench opening as recited in claim 3, and means for swivelling said bucket means 360 degrees with respect to the boom means to position the bucket means parallel to said trench opening.

5. A system for tamping of material in a trench opening as recited in claim 1, wherein said vibrator means is connected to a top side of said bucket means and there connected to the opposite end of said boom means, said system further consisting of a rubber cushion device to absorb vibrations from said vibration means.

6. A system for tamping of material in a trench opening as recited in claim 1, wherein said bucket means is constructed and adapted to retrieve, or grasp material for backfilling said trench opening and concurrently close one bucket inside the other.

7. A system for tamping of material in a trench opening as recited in 1, wherein said means for periodically vibrating said bucket means is positioned between the opposite end of said boom means and said bucket means, said system further incorporating a rubber cushion device to absorb vibrations from said vibration means.

* * * * *